US007985005B2

(12) United States Patent
Alexander et al.

(10) Patent No.: US 7,985,005 B2
(45) Date of Patent: Jul. 26, 2011

(54) LIGHTING ASSEMBLY AND LIGHT MODULE FOR SAME

(75) Inventors: Clayton Alexander, Westlake, CA (US); Todd Metlen, Ojai, CA (US); Doug Botos, San Diego, CA (US); Jesse Melrose, San Diego, CA (US); Kevin Walker, Raleigh, NC (US)

(73) Assignee: Journée Lighting, Inc., Westlake Village, CA (US)

( * ) Notice: Subject to any disclaimer, the term of this patent is extended or adjusted under 35 U.S.C. 154(b) by 708 days.

(21) Appl. No.: 11/715,071

(22) Filed: Mar. 6, 2007

(65) Prior Publication Data

US 2007/0279921 A1 Dec. 6, 2007

Related U.S. Application Data

(60) Provisional application No. 60/809,569, filed on May 30, 2006.

(51) Int. Cl.
*F21V 29/00* (2006.01)

(52) U.S. Cl. ..... 362/294; 362/249.02; 362/373; 362/249.11

(58) Field of Classification Search ..... 362/294, 362/373; 11/294, 373
See application file for complete search history.

(56) References Cited

U.S. PATENT DOCUMENTS

| | | | | |
|---|---|---|---|---|
| 2,430,472 A | | 11/1947 | Levy | |
| D149,124 S | | 3/1948 | Hewitt | |
| D152,115 S | | 12/1948 | Mehr | |
| D191,734 S | | 11/1961 | Daher et al. | |
| D217,096 S | | 4/1970 | Birns | |
| 3,538,321 A | * | 11/1970 | Keller et al. | 362/289 |
| 3,639,751 A | | 2/1972 | Pichel | |
| 4,091,444 A | | 5/1978 | Mori | |
| 4,453,203 A | | 6/1984 | Pate | |
| 4,578,742 A | * | 3/1986 | Klein et al. | 362/294 |
| 4,733,335 A | | 3/1988 | Serizawa et al. | |
| 4,761,721 A | | 8/1988 | Willing | |
| 4,872,097 A | * | 10/1989 | Miller | 362/649 |
| D322,862 S | | 12/1991 | Miller | |
| D340,514 S | | 10/1993 | Liao | |

(Continued)

FOREIGN PATENT DOCUMENTS

JP 2004/265626 A 9/2004

(Continued)

OTHER PUBLICATIONS

PCT International Search Report and the Written Opinion mailed Jun. 23, 2008, in related PCT Application No. PCT/US2007/023110.

(Continued)

*Primary Examiner* — Anabel M Ton
(74) *Attorney, Agent, or Firm* — Knobbe Martens Olson & Bear, LLP

(57) ABSTRACT

A light module is removably coupleable to a light fixture and includes an LED lighting element mounted on a mounting base that is operatively coupled to a housing. The light module also includes one or more resilient members that operatively couple the mounting base to the housing and allow the mounting base and housing to resiliently move relative to each other. The resilient members compress when the light module is removably coupled to the light fixture to exert a generally axial force on the mounting base to drive the mounting base into resilient contact with a surface of the light fixture to provide a thermal coupling between the light module and the light fixture.

40 Claims, 3 Drawing Sheets

U.S. PATENT DOCUMENTS

| | | | | |
|---|---|---|---|---|
| 5,303,124 | A | 4/1994 | Wrobel | |
| 5,337,225 | A | 8/1994 | Brookman | |
| 5,634,822 | A | 6/1997 | Gunell | |
| D383,236 | S | 9/1997 | Krogman | |
| 5,909,955 | A | 6/1999 | Roorda | |
| 6,072,160 | A | 6/2000 | Bahl | |
| D437,449 | S | 2/2001 | Soller | |
| D437,652 | S | 2/2001 | Uhler et al. | |
| D443,710 | S | 6/2001 | Chiu | |
| D446,592 | S | 8/2001 | Leen | |
| D448,508 | S | 9/2001 | Benghozi | |
| D457,673 | S | 5/2002 | Martinson et al. | |
| 6,441,943 | B1 | 8/2002 | Roberts et al. | |
| D462,801 | S | 9/2002 | Huang | |
| D464,455 | S | 10/2002 | Fong et al. | |
| D465,046 | S | 10/2002 | Layne et al. | |
| 6,478,453 | B2 * | 11/2002 | Lammers et al. | 362/294 |
| D470,962 | S | 2/2003 | Chen | |
| D476,439 | S | 6/2003 | O'Rourke | |
| 6,632,006 | B1 | 10/2003 | Rippel et al. | |
| D482,476 | S | 11/2003 | Kwong | |
| 6,682,211 | B2 | 1/2004 | English et al. | |
| 6,703,640 | B1 | 3/2004 | Hembree et al. | |
| 6,744,693 | B2 * | 6/2004 | Brockmann et al. | 362/321 |
| 6,787,999 | B2 * | 9/2004 | Stimac et al. | 315/51 |
| 6,864,513 | B2 | 3/2005 | Lin et al. | |
| 6,871,993 | B2 * | 3/2005 | Hecht | 362/555 |
| D504,967 | S | 5/2005 | Kung | |
| 6,902,291 | B2 | 6/2005 | Rizkin et al. | |
| 6,905,232 | B2 | 6/2005 | Lin | |
| 6,966,677 | B2 * | 11/2005 | Galli | 362/373 |
| D516,229 | S | 2/2006 | Tang | |
| D524,975 | S | 7/2006 | Oas | |
| D527,119 | S | 8/2006 | Maxik et al. | |
| 7,097,332 | B2 | 8/2006 | Vamberi | |
| 7,111,963 | B2 | 9/2006 | Zhang | |
| 7,132,804 | B2 | 11/2006 | Lys et al. | |
| 7,198,386 | B2 | 4/2007 | Zampini et al. | |
| 7,207,696 | B1 | 4/2007 | Lin | |
| D541,957 | S | 5/2007 | Wang | |
| D544,110 | S | 6/2007 | Hooker et al. | |
| D545,457 | S | 6/2007 | Chen | |
| D564,119 | S | 3/2008 | Metlen | |
| 7,344,279 | B2 | 3/2008 | Mueller et al. | |
| 7,344,296 | B2 | 3/2008 | Nobuyuki et al. | |
| 7,357,534 | B2 * | 4/2008 | Snyder | 362/294 |
| 7,396,139 | B2 | 7/2008 | Savage | |
| 7,396,146 | B2 | 7/2008 | Wang | |
| 7,413,326 | B2 * | 8/2008 | Tain et al. | 362/294 |
| D577,453 | S | 9/2008 | Metlen | |
| 7,452,115 | B2 * | 11/2008 | Alcelik | 362/516 |
| D585,588 | S | 1/2009 | Alexander et al. | |
| D585,589 | S | 1/2009 | Alexander et al. | |
| 7,494,248 | B2 * | 2/2009 | Li | 362/294 |
| 7,722,227 | B2 * | 5/2010 | Zhang et al. | 362/364 |
| 7,740,380 | B2 * | 6/2010 | Thrailkill | 362/294 |
| 2002/0067613 | A1 | 6/2002 | Grove | |
| 2003/0185005 | A1 | 10/2003 | Sommers et al. | |
| 2004/0212991 | A1 | 10/2004 | Galli | |
| 2005/0047170 | A1 | 3/2005 | Hilburger et al. | |
| 2005/0122713 | A1 * | 6/2005 | Hutchins | 362/205 |
| 2005/0146884 | A1 | 7/2005 | Scheithauer | |
| 2005/0174780 | A1 | 8/2005 | Park | |
| 2006/0076672 | A1 | 4/2006 | Petroski | |
| 2006/0262544 | A1 | 11/2006 | Piepgras et al. | |
| 2006/0262545 | A1 | 11/2006 | Piepgras et al. | |
| 2007/0025103 | A1 | 2/2007 | Chan | |
| 2007/0253202 | A1 | 11/2007 | Wu et al. | |
| 2007/0297177 | A1 | 12/2007 | Wang et al. | |
| 2008/0013316 | A1 | 1/2008 | Chiang | |
| 2008/0080190 | A1 | 4/2008 | Walczak et al. | |
| 2008/0084700 | A1 | 4/2008 | Van De Ven | |
| 2008/0106907 | A1 | 5/2008 | Trott et al. | |
| 2008/0130275 | A1 | 6/2008 | Higley et al. | |
| 2008/0158887 | A1 | 7/2008 | Zhu et al. | |

FOREIGN PATENT DOCUMENTS

| | | | |
|---|---|---|---|
| JP | 2007/273209 | A | 10/2007 |
| WO | WO DM/57383 | | 9/2001 |
| WO | WO 2004/071143 | | 8/2004 |
| WO | WO 2007/128070 | A1 | 11/2007 |

OTHER PUBLICATIONS

International Search Report and Written Opinion as mailed on Jan. 19, 2010, received in PCT Application PCT/US09/64858.

Non-final Office Action mailed on Jun. 25, 2010, in U.S. Appl. No. 12/149,900.

PCT International Search Report and the Written Opinion mailed Jun. 25, 2009, in related PCT Application No. PCT/US2009/035321.

International Search Report and Written Opinion mailed on Oct. 14, 2010 in PCT Application No. PCT/US2010/045361.

* cited by examiner

LIGHTING ASSEMBLY AND LIGHT MODULE FOR SAME

PRIOR APPLICATION

This application claims the benefit of priority to U.S. Provisional Patent Application No. 60/809,569, filed May 30, 2006, the entire contents of which are hereby incorporated by reference in their entirety.

BRIEF DESCRIPTION

1. Technical Field

The present invention is directed to a lighting assembly which may include passive cooling components integrated therein.

2. Background

Lighting assemblies such as lamps, ceiling lights, and track lights are important fixtures in any home or place of business. Such assemblies are used to not only illuminate an area, but often also to serve as a part of the décor of the area. However, it is often difficult to combine both form and function into a lighting assembly without compromising one or the other.

Traditional lighting assemblies typically use incandescent bulbs. Incandescent bulbs, while inexpensive, are not energy efficient, and have a poor luminous efficiency. To attempt to address the shortcomings of the incandescent bulbs, a move is being made to use more energy efficient and longer lasting sources of illumination, such as fluorescent bulbs and light emitting diodes (LEDs). Fluorescent bulbs require a ballast to regulate the flow of power through the bulb, and thus can be difficult to incorporate into a standard lighting assembly. Accordingly, LEDs, formerly reserved for special applications, are increasingly being considered as a light source for more conventional lighting assemblies.

LEDs offer a number of advantages over incandescent and fluorescent bulbs. For example, LEDs produce more light per watt than incandescent bulbs, LEDs do not change their color of illumination when dimmed, and LEDs can be constructed inside solid cases to provide increased protection and durability. LEDs also have an extremely long life span when conservatively run, sometimes over 100,000 hours, which is twice as long as the best fluorescent bulbs and twenty times longer than the best incandescent bulbs. Moreover, LEDs generally fail by a gradual dimming over time, rather than abruptly burning out, as do incandescent bulbs. LEDs are also desirable over fluorescent bulbs due to their decreased size and lack of need of a ballast, and can be mass produced to be very small and easily mounted onto printed circuit boards.

LEDs, however, have heat-related limitations. The performance of an LED often depends on the ambient temperature of the operating environment, such that operating an LED in an environment having a moderately high ambient temperature can result in overheating the LED, and premature failure of the LED. Moreover, operation of an LED for extended period of time at an intensity sufficient to fully illuminate an area may also cause an LED to overheat and prematurely fail. Accordingly, an important consideration in using an LED in a lighting assembly is to provide adequate passive or active cooling.

Active cooling mechanisms, such as fans, may be difficult to implement in a lighting assembly, as they often increase the size and power consumption of the assembly, and drain additional power. Passive cooling structures, such as heat sinks, may also be difficult to incorporate as they increase the size of the lighting assembly. Moreover, traditional heat sinks can be as much of a detriment to incorporation in traditional lighting assignments as a ballast can be in a fluorescent bulb assembly. Accordingly, there is a need for providing adequate cooling in a lighting assembly, such as an LED lighting assembly, without significantly increasing the size, and without taking away from the aesthetics and ambience that a lighting assembly can add to an area.

BRIEF SUMMARY

Consistent with the present invention, there is provided a lighting assembly comprising a light module including a lighting element; an enclosure having a recess for receiving and housing the light module; a thermally conductive core connected to the light module through the enclosure; and a housing mounted in thermal contact with the core and the enclosure, so as to cause the housing to dissipate heat to an ambient atmosphere.

Consistent with the present invention, there is also provided a method for manufacturing a lighting assembly, comprising affixing a top core portion of a thermally conductive core to a bottom enclosure portion of an enclosure using a thermally-conductive adhesive; affixing a housing to a bottom core portion of the thermally-conductive core using a thermally-conductive adhesive; resiliently mounting a light module, including at least one lighting element, on a top enclosure portion in a recess of the enclosure using spring compression; and attaching a protective cover to the enclosure to enclose the light module.

Also consistent with the present invention, a light module is provided for use in a lighting assembly. The light module comprises a mounting base positioned on the lighting assembly, a first thermally conductive material positioned between the lighting assembly and the mounting base, a lighting element mounted on the mounting base, a second thermally conductive material positioned between the lighting element and the mounting base, and a resilient mounting component removably affixing the light module in the lighting assembly.

Additional features and advantages consistent with the invention will be set forth in part in the description which follows, and in part will be obvious from the description, or may be learned by practice of the invention. The features and advantages consistent with the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one embodiment consistent with the invention and together with the description, serve to explain the principles of the invention.

DETAILED DESCRIPTION

Reference will now be made in detail to the exemplary embodiments consistent with the present invention, an example of which is illustrated in the accompanying drawings. Wherever possible, the same reference numbers will be used throughout the drawings to refer to the same or like parts.

Figure 1:
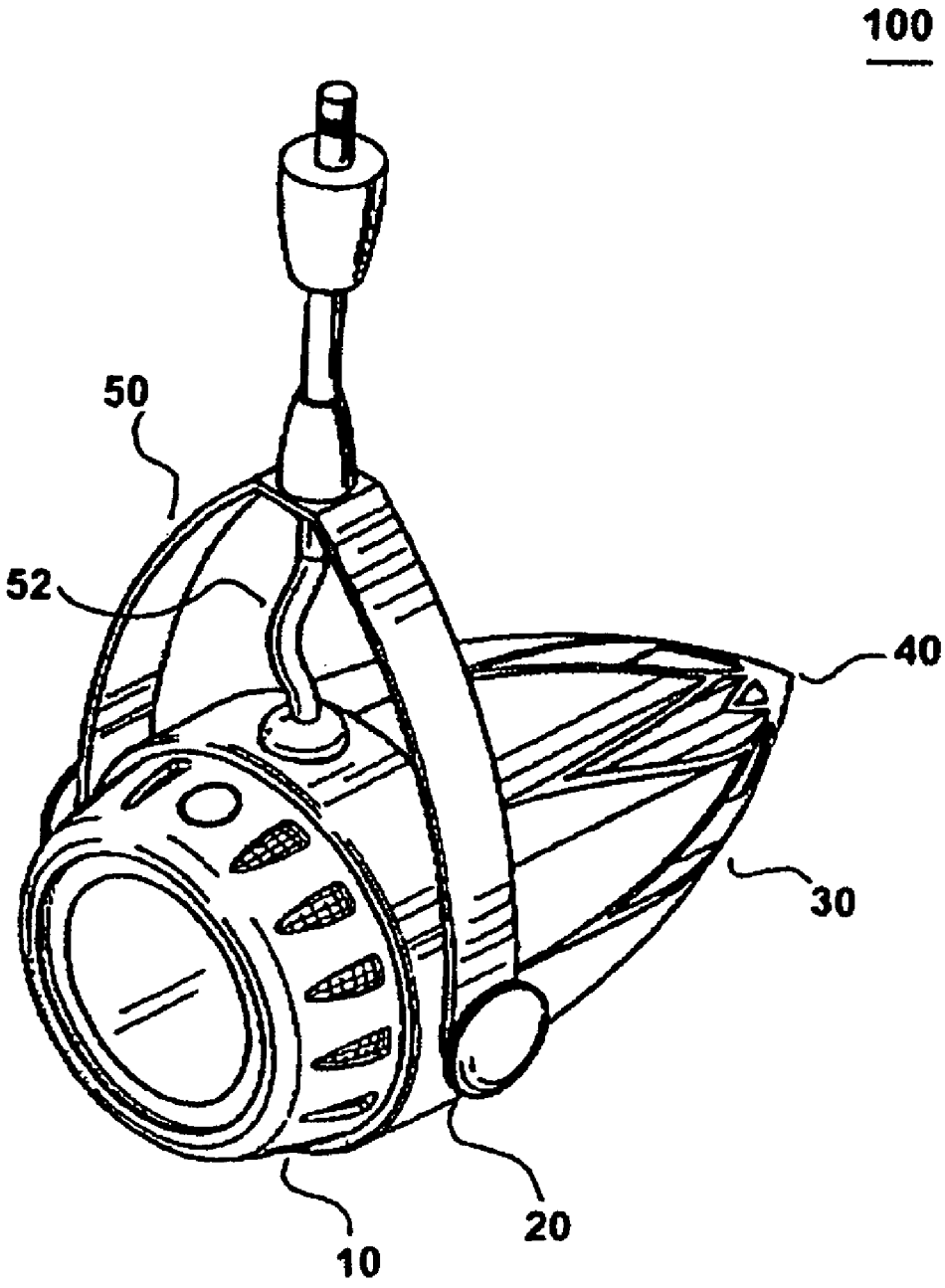
FIG. 1 is a perspective view of a lighting assembly consistent with the present invention.
Figure 3B:
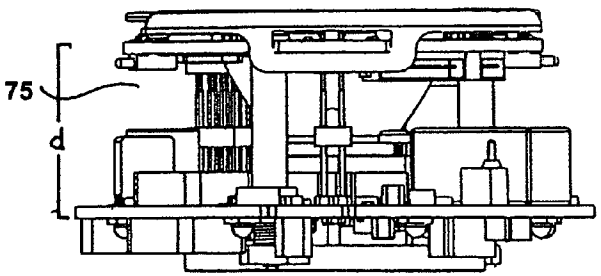
FIG. 3B is side view of the light module of FIG. 3A.
Figure 3A:
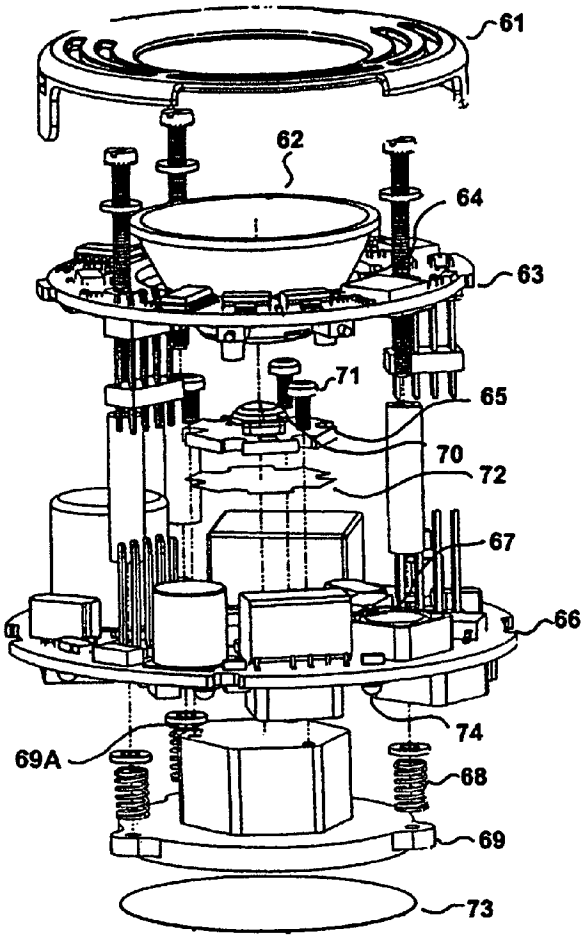
FIG. 3A is an exploded view of a light module of FIG. 2.

FIG. 1 is an illustration of a lighting assembly 100 consistent with the present invention. In one embodiment, lighting assembly 100 includes a protective cover 10, an enclosure 20, a housing 30, and a core 40. Further consistent with the present invention, lighting assembly may also include a light module 60, as illustrated in FIGS. 3A and 3B.

In some embodiments consistent with the present invention, lighting assembly may also include a mounting bracket 50, and a power cable 52. Mounting bracket 50 may be used to mount lighting assembly 100 to a stationary fixture, such as a wall, a light stand, or a ceiling. In an embodiment consistent with the present invention, mounting bracket 50 may be used to mount lighting assembly 100 to a track used in a track lighting fixture. Power cable 52 may be used as a connector to provide power from an external power source to lighting assembly 100.

Figure 2:
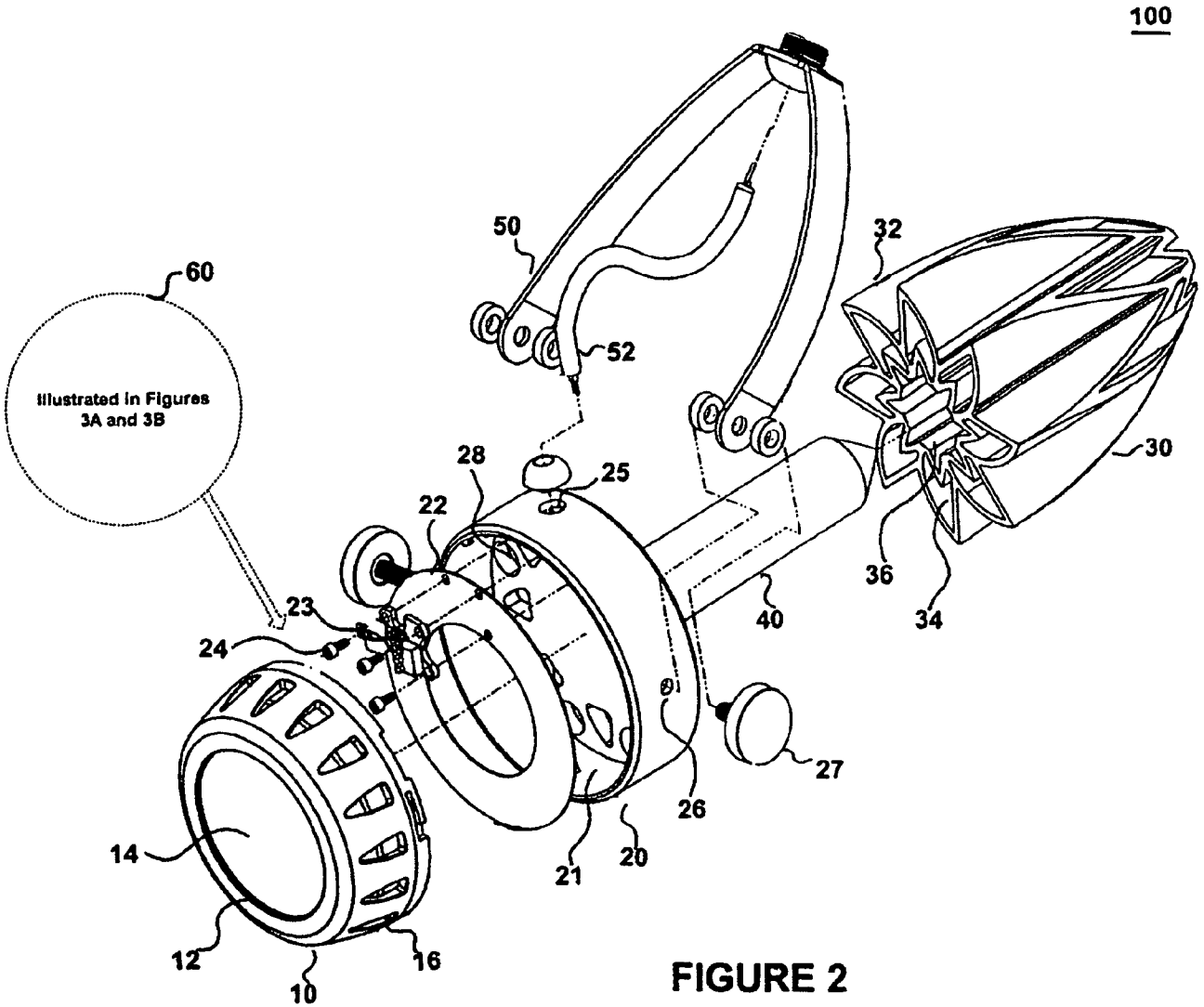
FIG. 2 is an exploded view of the lighting assembly of FIG. 1.

FIG. 2 is an exploded view of the lighting assembly of FIG. 1. As shown in FIG. 2, cover 10 may be attached to enclosure 20 enclosing light module 60 therein. Although light module 60 is not fully illustrated in FIG. 2, it is fully illustrated in FIGS. 3A and 3B. The placement of light module 60 in relation to protective cover 10 and enclosure is shown in FIG. 2 for illustrative purposes only using dotted lines.

Returning to FIG. 2, cover 10 may include a main aperture 12 formed in a center portion of cover 10, a transparent member, such as a lens 14 formed in aperture 12, and a plurality of peripheral holes 16 formed on a periphery of cover 10. Lens 14 allows light emitted from a lighting element to pass through cover 10, while also protecting the lighting element from the environment. Lens 12 may be made from any transparent material to allow light to flow therethrough with minimal reflection or scattering. Consistent with the present invention, cover 10, enclosure 20, endow. % housing 30, and core 40 may be formed from materials having a high thermal conductivity. Cover 10, enclosure 20, housing 30, and core 40, may be formed from the same material, or from different materials. For example, in one embodiment consistent with the present invention, cover 10, enclosure 20, housing 30, and core 40 are formed from the same material, such as a material having a thermal conductivity greater than 80 W/mK. Consistent with the present invention the material may be aluminum, or anodized aluminum.

Peripheral holes 16 may be formed on the periphery of cover 10 such that they are equally spaced and expose portions along an entire periphery of the cover 10. Although a plurality of peripheral holes 16 are illustrated, embodiments consistent with the present invention may use one or more peripheral holes 16 or none at all. Consistent with an embodiment of the present invention, peripheral holes 16 are designed to allow air to flow through cover 10 and over light module 60 to dissipate heat. Consistent with another embodiment of the present invention, peripheral holes 16 may be used to allow light emitted from light module 60 to pass through peripheral holes 16 to provide a corona effect on cover 10.

Enclosure 20 may include a recess 21 wherein light module 60 is removably mounted. Enclosure 20 may also include a mounting ring 22 having a plurality of electrical contacts 23 attached thereon using fasteners 24. A power source opening 25 may be formed on a periphery of enclosure 20, and a power source grommet may be attached to power source opening 25 for receiving power source cable 52 and establishing an electrical connection with electrical contacts 23. In embodiments consistent with the present invention, power source cable 52 may be fixably attached to enclosure 20, however in other embodiments consistent with the present invention, power source cable 52 may be removably attached to enclosure 20.

Fastening holes 26 may be further formed on a periphery of enclosure 20 for use in fastening mounting bracket 50 to enclosure 20 using fastening screws 27. Ventilation holes 28 may also be formed on a bottom surface of enclosure 20 for allowing air to flow over light module 60 and out to an ambient atmosphere or through housing 30 and then out to an ambient atmosphere, thereby passively assisting in cooling light module.

Consistent with an embodiment of the present invention, electrical contacts 23 provide an electrical connection to light module 60 when light module is mounted therein. Contact pads (not illustrated) may be attached to a bottom surface of light module 60 for establishing an electrical connection with electrical contacts so that when power source cable 52 is plugged into enclosure 20, power is provided through power source cable 52 to electrical contacts 23 and into light module 60 through the contact pads.

Consistent with the present invention, light module 60 may be removable from the enclosure using, for example, plug-in connections. Removable light module 60 may allow a user to safely remove power from light module 60 so that the user can then remove light module 60 and replace, repair, calibrate, or test light module 60. Specifically, light module 60 may be formed to be replaceable, allowing a user to replace light module 60 without having replace any of the other components of lighting assembly 100. Moreover, light module 60 may be removed and replaced while lighting assembly 100 remains mounted.

FIG. 2 further illustrates a thermally-conductive core 40. Consistent with the present invention, core 40 may have a spike shape, or a "T" shape. Consistent with the present invention, core 40 may be affixed to a bottom surface of enclosure 20 using a thermally-conductive adhesive (not illustrated). In one embodiment consistent with the present invention, the thermally-conductive adhesive may be a SE4486 CV Thermally Conductive Adhesive manufactured by Dow Corning Corporation, although other thermally-conductive adhesives may be used.

Consistent with the present invention, core 40 acts as a conduit for conducting heat produced by light module 60 through enclosure 20 and out to an ambient atmosphere through portions of housing 30 and through an end portion of core 40.

Housing 30 may be made from an extrusion including a plurality of surface-area increasing structures, such as ridges 32. Ridges 32 may serve multiple purposes. For example, ridges 32 may provide heat dissipating surfaces so as to increase the overall surface area of housing 30, providing a greater surface area for heat to dissipate to an ambient atmosphere over. That is, ridges 32 may allow housing 30 to act as an effective heat sink for lighting assembly 100. Moreover, ridges 32 may also be formed into any of a variety of shapes and formations such that housing 30 takes on an aesthetic quality. That is, ridges 32 may be formed such that housing 30 is shaped into an ornamental extrusion having aesthetic appeal. For example, housing 30, as shown in FIG. 2, has a floral shape, with ridges 32 formed as flutes. However, housing 30 may be formed to have a plurality of other shapes. Accordingly, housing 30 may function not only as a ornamental feature of lighting assembly 100, but also as a heat sink for cooling light module 60.

Housing 30 may also include a plurality of housing holes 34, which are formed to extend from a top portion of housing 30 (to the left in FIG. 2) through a bottom portion of housing 30 (to the right in FIG. 2). Housing holes 34 are formed to not only reduce the weight of housing 30, but also to further increase the air flow through lighting assembly 100. Thus, air may flow through periphery holes 16, over light module 60, through ventilation holes 28 and through housing holes 34 to be dissipated into an ambient atmosphere through a bottom portion of housing 30, or to be dissipated through housing 30 into the ambient atmosphere. In one embodiment consistent with the present invention, housing holes 34 are formed such that they are in alignment with ventilation holes 28.

Consistent with the present invention, housing 30 may further include a core hole 36 which extends from a top portion of housing 30 through a bottom portion thereof (to the right in FIG. 2). Core hole 36 may receive a bottom portion of core 40 such that housing 30 may be affixed to core 40. Consistent with an embodiment of the present invention, housing 30 may be affixed to core 40 using a thermally-conductive adhesive. The thermally-conductive adhesive may be a SE4486 CV Thermally Conductive Adhesive manufactured by Dow Corning Corporation, although other thermally-conductive adhesives may be used.

Housing 30 may be affixed to core 40 such that a top surface of the top portion of housing 30 is flush with a bottom surface of enclosure 20, thereby establishing secure thermal contact between housing 30 and enclosure 20. A thermally-conductive adhesive may further be used to resiliently establish the thermal contact between housing 30 and enclosure 20. Establishing a secure thermal contact between housing 30 and enclosure may aid in cooling light module 60. For example, a top surface of ridges 32 may be mounted flush against a bottom portion of enclosure 20 such that heat generated by light module 60, which is resiliently mounted in recess 21 of enclosure 20, is conducted through the bottom portion of enclosure 20, into ridges 32, and then dissipated into the ambient atmosphere.

FIG. 3A is an exploded view of a light module consistent with the present invention. As shown in FIG. 3A, light module 60 includes, from top to bottom, a detachable protective shroud 61, a tapered optical element, or reflector 62, a first circuit board 63 having a first circuit board hole 64 formed therein, a lighting element 65, a second circuit board 66 having a second circuit board hole 67 formed therein, resilient mounting components 68, and a mounting base 69.

As shown in FIG. 3A, first circuit board 63 may be stacked on second circuit board 66, and may be formed to have a first circuit board hole 64, wherein tapered optical element 62 is mounted thereon to extend through first circuit board hole 64. Consistent with the present invention, tapered optical element 62 may be formed such that it has a top portion which is wider than a bottom portion, such that the bottom portion is able to extend through first circuit board hole 64. Moreover, tapered optical element 62 may comprise a plurality of reflective surfaces formed on an interior surface to direct light emitted from lighting element 65, and/or provide additional protection for lighting element 65.

Second circuit board 66 may be formed such that second circuit board hole 67 receives a top portion 69A of mounting base 69. Consistent with the present invention, mounting base 69 may be formed such that top portion 69A is narrower than a bottom portion, allowing top portion 69A to extend through second circuit board hole 67. Moreover, mounting base 69 may formed from a material having a high thermal conductivity. Consistent with the present invention, mounting base 69 may be formed from copper. Lighting element 65 may then be mounted on top surface 69A of mounting base 69.

As shown in FIG. 3A, lighting element 65 includes a light emitting diode (LED) chip 70. Although the illustrated embodiment uses an LED as a lighting element, consistent with other embodiments of the present invention, other lighting elements may also be used. LED chip 70 may comprise a chip having at least one light emitting diode device mounted thereon. For example, LED chip 70 may comprise an OSTAR 6-LED chip manufactured by OSRAM GmbH, having an output of 400-650 lumens.

Lighting element 65 may then be mounted on mounting base 69 using fasteners 71, which may be screws or other well-known fasteners. Positioned between lighting element 65 and mounting base 69 is a first thermally-conductive material 72, which acts as a void-filler between lighting element 65 and mounting base 69. Essentially, the machining of both the bottom surface of lighting element 65 and mounting base 69 during the manufacturing process may leave minor imperfections in these surfaces, forming voids. These voids may be microscopic in size, but may act as an impedance to thermal conduction between the bottom surface of lighting element 65 and top surface 69A of mounting base 69. First thermally-conductive 72 material then acts to fill in these voids to reduce the thermal impedance between lighting element 65 and mounting base 69, resulting in improved thermal conduction. Moreover, consistent with the present invention, first thermally-conductive material 72 may be a phase-change material which changes from a solid to a liquid at a predetermined temperature, thereby improving the gap-filling characteristics of first thermally-conductive material 72. For example, thermally-conductive material 72 may include a Hi-Flow 225F-AC phase-change material, manufactured by The Bergquist Company, which is designed to change from a solid to a liquid at 55° C.

Mounting base 69 having lighting element 65 mounted thereon is then resiliently mounted to the stacked first circuit board 63 and second circuit board 66 using resilient mounting components 68. Consistent with the present invention, mounting base 69 may be mounted to the stacked first circuit board 63 second circuit board 66 using resilient mounting components 68 prior to mounting lighting element 65 on mounting base 69.

Resilient mounting components 68 may be located so as to mount mounting base 69 to the stacked first and second circuit boards 63 and 66 and provide a substantially even clamping force across the surfaces of lighting element 65 and mounting base 69. By using resilient mounting components 68, the thermal impedance caused by voids between lighting element 65 and mounting base 69 are minimized, and thermal conductivity is improved. In the embodiment illustrated in FIG. 3A, resilient mounting components 68 may comprise compression spring members. Other embodiments consistent with the present invention may also be provided, in which resilient mounting components 68 may comprise elastic members, such as, for example, rubber tubing members.

A bottom surface of light module 60 may be mounted in recess 21 of enclosure 20 (FIG. 2). Specifically, light module 60 may be mounted such that a bottom surface of mounting base 69 is in contact with a top surface of enclosure 20 in recess 21. Consistent with the present invention, a second thermally-conductive material 73 (FIG. 3A) may be positioned between mounting base 69 and enclosure 20 to minimize thermal impedance therebetween, similar to first thermally-conductive material 72. Second thermally-conductive material 73 may also be a phase-change material, such as a Hi-Flow 225UF manufactured by The Bergquist Company.

Consistent with the present invention, second circuit board 66 may have at least one secondary LED 74 mounted on a back surface. As shown in FIG. 3A, second circuit board 66 has a plurality of secondary LEDs 74 mounted on a back surface. Consistent with the present invention, secondary LEDs 74 may be attached to the second circuit board 66 such that they are aligned with ventilation holes 28 (FIG. 2). Such an arrangement may allow secondary LEDs 74 to emit secondary light which passes through ventilation holes 28 and illuminates housing 30 and ridges 32. The secondary light may further cast shadows on an area behind lighting assembly 100 in the shape of housing 30, increasing the aesthetic effect provided by lighting assembly 100.

Detachable protective shroud 61 may also be mounted on lighting element 65 to protect tapered optical assembly 62, and other components on the first and second circuit boards. Consistent with one embodiment of the present invention, detachable protective shroud is made from a synthetic material, and is mounted such that it rests upon a top surface of first circuit board 63.

FIG. 3B is side view of the light module showing a gap 75 between first and second circuit boards, consistent with the present invention. As shown in FIG. 3B, light module 60 is assembled such that there is a predetermined gap having a distance d between first circuit board 63 and second circuit board 66. Although light module 60 is illustrated in FIGS. 3A and 3B as having two circuit boards, in embodiments consistent with the present invention, light module may be formed to have one circuit board, or more than two circuit boards. Moreover, in other embodiments consistent with the present invention, light module 60 may have a micro fan mounted thereon to actively cool lighting element 65, or a passive heat sink mounted on a circuit board to passively cool lighting element 65. Furthermore, embodiments consistent with the present invention may use a combination of heat sinks and fans mounted on light element 65, and other combinations of active and passive cooling components.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A lighting assembly comprising:

a light module including a lighting element;

an enclosure having a recess for removably receiving and housing at least a portion of the light module;

a thermally conductive core removably coupleable to the light module through the enclosure, the thermally conductive core having an elongate shape; and a housing mounted in thermal contact with the core and the enclosure, the housing disposed circumferentially about the elongate thermally conductive core and extending co-axially therewith along a length of the thermally conductive core, one or both of the core and housing configured to dissipate heat from the lighting element to an ambient atmosphere.

2. The lighting assembly according to claim 1, further comprising:

a protective cover attached to the enclosure, the cover having a transparent cover formed therein for allowing light emitted from the lighting element to pass therethrough, and at least one hole formed on a periphery of the protective cover to permit air flow through the cover.

3. The lighting assembly according to claim 1, wherein the lighting element comprises a light emitting diode (LED) device.

4. The lighting assembly according to claim 3, wherein the LED device comprises an LED chip having at least one LED mounted thereon.

5. The lighting assembly according to claim 1, wherein the light module further comprises:

a mounting base having a top base portion and a bottom base portion, the bottom base portion being wider than the top base portion, the top base portion extending through the second hole; and a tapered optical element for directing light emitted from the lighting element, the tapered optical element having an upper element portion and a lower element portion, the lower element portion being narrower than the upper element portion.

6. The lighting assembly according to claim 5, wherein the top base portion has a top mounting base surface, and the bottom base portion has a bottom mounting base surface;

the lighting element is mounted on the top mounting base surface with a first thermally conductive material positioned therebetween; and the bottom mounting base surface is thermally coupleable with the core through the enclosure, with a second thermally conductive material positioned between the bottom mounting base surface and the enclosure.

7. The lighting assembly according to claim 1, further comprising one or more resilient mounting components in the light module that compress when the light module is coupled to the enclosure and that provides a substantially even force against the mounting base, thereby driving the mounting base of the light module into resilient contact with a surface of the enclosure.

8. The lighting assembly according to claim 7, wherein the resilient mounting component comprises one of a spring compression assembly or a resilient rubber tubing assembly.

9. The lighting assembly according to claim 1, wherein the enclosure includes electrical contacts connectable to an external power source for establishing a detachable electrical connection with the light module.

10. The lighting assembly according to claim 9, wherein the enclosure includes a power source opening for receiving a connector to the external power source.

11. The lighting assembly according to claim 1, wherein the enclosure comprises a plurality of holes formed in a bottom surface of the enclosure.

12. The lighting assembly according to claim 1, comprising a thermally-conductive adhesive affixing the core to the enclosure and the housing.

13. The lighting assembly according to claim 1, wherein the core is mechanically coupled to the light module, the enclosure, and the housing so as to transfer heat from the light module to the enclosure and into the housing.

14. The lighting assembly according to claim 1, wherein the housing comprises a plurality of surface area-increasing structures having heat dissipating surfaces.

15. The lighting assembly according to claim 14, wherein the surface-increasing structures comprise flutes.

16. The lighting assembly according to claim 14, wherein the housing has a floral shape.

17. The lighting assembly according to claim 1, wherein the housing comprises a plurality of holes formed therethrough.

18. The lighting assembly according to claim 1, wherein the housing comprises an extruded housing.

19. The lighting assembly according to claim 1, wherein the enclosure, the thermally conductive core, and the housing are formed from a material having a thermal conductivity greater than 80 W/mK.

20. The lighting assembly according to claim 19, wherein the material comprises aluminum.

21. The lighting assembly according to claim 20, wherein the material comprises anodized aluminum.

22. A light module removably coupleable to a light fixture, the light module comprising:

an LED lighting element;

a mounting base, the LED lighting element mounted on the mounting base;

a housing operatively coupled to the mounting base; and one or more resilient members that operatively couple the mounting base to the housing and allow the mounting base and housing to resiliently move relative to each other, wherein the resilient members compress when the light module is removably coupled to the light fixture to exert a generally axial force on the mounting base to drive the mounting base into resilient contact with a surface of the light fixture to provide a thermal coupling between the light module and the light fixture.

23. The light module according to claim 22, wherein the LED lighting element comprises an LED chip having at least one LED mounted thereon.

24. The light module according to claim 22, wherein the one or more resilient members resiliently couple the light module to the light fixture by biasing the light module against the light fixture with a force exerted substantially evenly across the mounting base of the light module.

25. The light module according to claim 24, wherein the one or more resilient members comprise one or more compression springs.

26. The light module according to claim 22, wherein the mounting base is formed of a thermally conductive material so as to thermally conduct heat from the lighting element to the light fixture.

27. The light module according to claim 22, further comprising at least one electrical contact that contacts an electrical contact on the light fixture upon coupling of the light module to the light fixture.

28. A lighting assembly comprising:

a light fixture comprising thermally conductive housing defining a mounting interface surface; and a light module removably mountable to the light fixture, the light module comprising:

an LED lighting element mounted on a mounting base;

a light module housing operatively coupled to the mounting base; and one or more resilient members operatively coupled to the light module housing that resiliently couple the light module housing to the light fixture when the light module is coupled to the light fixture, wherein the resilient members compress when the light module is removably coupled to the light fixture to exert a force on the mounting base that drives the mounting base into thermal communication with the mounting interface surface of the light fixture to provide a thermal connection therebetween to dissipate heat from the LED lighting element through the mounting base and thermally conductive housing.

29. The system of claim 28, wherein the light fixture further comprises an electrical contact releasably coupleable to an electrical contact on the light module to define an electrical connection when the light module is mounted to the light fixture.

30. The light module of claim 22, wherein the one or more resilient members comprise springs attached to the housing.

31. The light module of claim 22, wherein the LED lighting element is generally centrally located along a longitudinal axis of the light module.

32. The light module of claim 22, wherein a bottom surface of the mounting base is disposed below the housing.

33. The light module of claim 22, wherein the light module is generally symmetrical about a central axis of the light module.

34. The lighting assembly of claim 28, wherein the one or more resilient members comprise springs attached to the light module housing.

35. The lighting assembly of claim 28, wherein the LED lighting element is generally centrally located along a longitudinal axis of the light module.

36. The lighting assembly of claim 28, wherein a bottom surface of the mounting base is disposed below the light module housing.

37. The lighting assembly of claim 28, wherein the light module is generally symmetrical about a central axis of the light module.

38. A lighting assembly, comprising:

a light module comprising an LED lighting element;

a light fixture comprising a generally cylindrical recess that removably receives at least a portion of the light module when coupling the light module to the light fixture, wherein at least a portion of the light module is axially introduced into the cylindrical recess; and one or more resilient members configured to compress when the light module is removably coupled to the light fixture to exert a generally axial force on at least a portion of the light module to resiliently drive at least a portion of the light module into resilient contact with a surface of the light fixture to thereby thermally couple at least a portion of the light module to the light fixture.

39. The lighting assembly of claim 38, wherein the one or more resilient members are disposed in the light module.

40. The lighting assembly of claim 39, wherein the one or more resilient members are disposed between a distal thermally conductive surface of a mounting base of the light module and a front end of the light module.

* * * * *

UNITED STATES PATENT AND TRADEMARK OFFICE

CERTIFICATE OF CORRECTION

PATENT NO. : 7,985,005 B2
APPLICATION NO. : 11/715071
DATED : July 26, 2011
INVENTOR(S) : Clayton Alexander et al.

It is certified that error appears in the above-identified patent and that said Letters Patent is hereby corrected as shown below:

Title Page, Other Pubs. item 56 on page 2, column 2, line 38, after "2010" please insert --received--.

At column 3, line 36, after "enclosure 20," please delete "endow. %".

At column 10, line 5, in Claim 29, please delete "The system of claim" and insert therefore, --The lighting assembly of claim--.

Signed and Sealed this
Tenth Day of April, 2012

David J. Kappos

David J. Kappos
*Director of the United States Patent and Trademark Office*